US006501383B1

(12) United States Patent
Haupenthal

(10) Patent No.: US 6,501,383 B1
(45) Date of Patent: Dec. 31, 2002

(54) METHOD AND DEVICE FOR MONITORING A FLAME

(75) Inventor: Karl-Friedrich Haupenthal, Gaggenau (DE)

(73) Assignee: Siemens Building Technologies AG, Zug (CH)

( * ) Notice: Subject to any disclaimer, the term of this patent is extended or adjusted under 35 U.S.C. 154(b) by 0 days.

(21) Appl. No.: 09/508,996

(22) PCT Filed: Oct. 8, 1998

(86) PCT No.: PCT/EP98/06392

§ 371 (c)(1),
(2), (4) Date: Apr. 5, 2000

(87) PCT Pub. No.: WO99/19672

PCT Pub. Date: Apr. 22, 1999

(30) Foreign Application Priority Data

Oct. 10, 1997 (EP) ..... 97117731

(51) Int. Cl.[7] ..... G08B 17/12
(52) U.S. Cl. ..... 340/578; 340/577
(58) Field of Search ..... 340/577, 578, 340/579, 509, 629, 505, 508; 169/61, 65, DIG. 3

(56) References Cited

U.S. PATENT DOCUMENTS

| | | | | |
|---|---|---|---|---|
| 4,039,844 A | * | 8/1977 | MacDonald | 340/578 |
| 4,823,114 A | * | 4/1989 | Gotisar | 340/578 |
| 4,923,117 A | * | 5/1990 | Adams et al. | 340/650 |
| 5,207,276 A | * | 5/1993 | Scofield | 169/65 |

FOREIGN PATENT DOCUMENTS

| | | |
|---|---|---|
| DE | 29 32 129 A1 | 2/1980 |
| DE | 30 26 787 A1 | 12/1981 |
| EP | 0 159 748 A1 | 10/1985 |
| EP | 0 388 065 A1 | 9/1990 |
| EP | 0 617 234 A1 | 9/1994 |
| EP | 0 634 611 A1 | 1/1995 |
| FR | 2 556 819 A1 | 6/1985 |

* cited by examiner

*Primary Examiner*—Van Trieu
(74) *Attorney, Agent, or Firm*—Proskauer Rose LLP

(57) ABSTRACT

The method according to the invention of monitoring a flame uses the known principle that a direct current signal ($I_F$) of different magnitude is produced in dependence on the presence or intensity of the flame from an ac voltage signal. That purpose is served for example by ionization electrodes (3) or ultraviolet sensors (4, 4*a*) which in dependence on the intensity of the flame produce a corresponding direct current signal. When the flame is extinguished no direct current signal is produced. The direct current signal ($I_F$) is detected by an evaluation circuit (6) and converted into a first output signal (A), wherein conversion is effected by various further circuit elements (7, 9, 10) in such a way that differently changing output signals ($A_1$, $A_2$) are obtained depending on the respective flame intensity. The evaluation circuit (6) also is acted upon by an ac voltage signal whose absence, upon failure of the evaluation circuit (6), deactivates a monitoring circuit (7), which results in a second output signal ($A_A$). That second output signal ($A_A$) is advantageously a static output signal so that it is possible to detect defective performance on the part of the evaluation circuit (6). The function of the monitoring circuit (7) itself can be periodically tested.

12 Claims, 5 Drawing Sheets

METHOD AND DEVICE FOR MONITORING A FLAME

BACKGROUND OF THE INVENTION

1. Field of the Invention

The invention concerns a method of monitoring a flame such as a flame of a gas or oil burner and an apparatus for monitoring a flame.

2. Description of the Prior Art

Monitoring gas flames frequently entails the use of flame monitors which utilize the rectifier effect of the flame, that is to say which operate on the basis of what is known as the ionization principle. In that procedure an ac voltage is applied between two electrodes. The volume which is filled by the flame depends on the instantaneous output of the burner. The direct current which can be produced can be very low at a low level of burner output and if the geometry of the electrodes is not the optimum, while the alternating current can be substantially greater in dependence on the capacitance of the sensor line. The flame signal amplifier must therefore be capable of filtering off the low direct current component in the overall sensor circuit current, without the alternating current being able to simulate a flame signal as a result of the inevitable rectifier effects in the amplifier input. Therefore the magnitude of the direct current component gives a measurement in respect of the intensity of the flame, in which respect the absence of a flame corresponds to the intensity of zero, the detection of which must be established reliably and very close to real time in order to avoid unburnt gas or oil from flowing out into the burner chamber.

In principle filtering of the direct current component can be implemented by an evaluation circuit which is connected upstream of the flame signal amplifier, such as for example a low pass filter with a sufficiently low limit frequency. If however the filter capability of the low pass filter is lost, for example because of a failure of a filter capacitor, the alternating current could simulate the presence of a flame, even when the flame is not present. The flame monitoring or burner control system must recognise that malfunction. In the case of burners involving intermittent operation, that is normally not a problem because, after the fuel supply is switched off, which results in the flame being extinguished, the control system can detect a simulated flame signal as being a defect and can prevent the burner from being set in operation again. In the case of burners in continuous operation the malfunction must be detected by periodically checking the flame monitor without the burner being taken out of operation for that purpose. In the case of optical flame sensors, this is generally effected by interrupting the beam path between the flame and the sensor by means of a shutter member, that is to say flame failure is temporarily simulated during operation of the assembly, and the output of the flame signal amplifier must suitably react thereto.

In principle the method of signal interruption at the flame sensor can also be used in regard to ionization flame monitoring. The ionization circuit could be interrupted by means of a suitable switch element. However that element would have to be disposed close to the sensor electrode so that only the flame signal current is interrupted and not for example also the alternating current which flows by way of line capacitances and whose flame-simulating effect in the event of a component fault is in fact precisely to be detected by the test. It would also be possible to envisage short-circuiting of the flame signal lines whereby the flame signal current also becomes zero, and the alternating current is even increased. For both cases, it would be necessary to use a switch element which is suitable for the high sensor ac voltage and which itself cannot assume a fault mechanism which results in undetected flame simulation.

In the present state of knowledge only an electromechanical relay can be considered for that purpose. That structure however is expensive in terms of material and equipment and requires a relatively high level of control power. The possibility of interrupting the sensor current with a relay contact is mentioned in German laid-open application (DE-OS) No 29 32 129 on page 6. DE 30 26 787 describes a construction in which there is a single filter capacitor at the input of the flame signal amplifier, which on the one hand serves as an energy storage means for the ionization current and whose discharge current on the other hand is required for dynamic operation of a semiconductor circuit. Failure of that filter capacitor has the consequence that the semiconductor circuit—even in the case of an alternating current caused by sensor line capacitances—goes into a constant state so that a flame is no longer signalled. The disadvantage of that arrangement is that a given minimum level of energy and thus a given minimum current must be supplied by the flame for dynamic operation of that semiconductor circuit. Therefore certain limits are set on the response sensitivity of that circuitry principle and it no longer satisfies all present-day requirements.

EP 159 748 discloses a circuit which leads to the assumption of a high level of response sensitivity insofar as the capacitive load current caused by line capacitances, at the sensor terminals, remains low in comparison with the flame signal current. In that respect this circuit does not satisfy the demands for a high level of response sensitivity and at the same time a high level of resistance in relation to line capacitance. A further requirement which is frequently specified is the display of flame intensity as a setting aid when bringing a burner into operation and for detecting changes of the flame in operation, in good time. The circuit disclosed in EP 159 748 does not afford that option.

The arrangement in accordance with the teaching of DE 30 26 787 supplies a pulse series in dependence on the magnitude of the flame current so that in that case it would be possible to derive a signal to indicate the flame intensity, but the dynamic range between response sensitivity and saturation limit is relatively small so that the circuit principle is only suitable for establishing "flame present".

EP 0 617 234 also discloses an ionization flame monitor with a circuit arrangement having a capacitor which is transferred by the ionization current from a condition of being charged up by the operating voltage into a discharged condition, wherein the signal "flame present" is output when the value falls below a given threshold. The function of the capacitor can be checked by means of a test signal. The disadvantage here is that the function of the capacitor has to be periodically tested, the system does not provide for continuous monitoring of the capacitor.

SUMMARY OF THE INVENTION

Therefore the object of the present invention is to provide a method and an apparatus for monitoring a flame which serves as a flame monitoring method and circuit respectively, the response sensitivity of which is substantially improved in comparison with the state of the art without detracting from compatibility for line capacitance, whose switch-off capability can be periodically checked during burner operation and also supplies an output signal representing a measurement in respect of flame intensity. The invention further seeks to provide that the method ensures continuous checking of the monitoring action.

According to a first aspect of the present invention, there is provided a method of monitoring a flame, wherein:

in dependence on the presence or intensity of the flame there is produced from a first electrical signal a second electrical signal of different magnitude, the second electrical signal is applied to an evaluation circuit and converted into a first output signal, and the evaluation circuit is acted upon by a monitoring signal which upon failure of the evaluation circuit leads to a second output signal.

According to a second aspect of the present invention, there is provided apparatus for monitoring a flame, comprising:

an evaluation circuit which in dependence on the presence or the intensity of the flame generates from a first electrical signal a second electrical signal of different magnitude, and circuit means which converts the second electrical signal into a first output signal, wherein the evaluation circuit can be acted upon with a monitoring signal which in the event of failure of the evaluation circuit leads to a second output signal.

Advantageous configurations are set forth in the dependent claims.

The method according to the invention of monitoring a flame makes use of the known principle that in dependence on the presence or the intensity of the flame there is produced from a first electrical signal (for example an ac voltage signal) a second electrical signal of different magnitude (for example a dc signal) ($I_F$) . A preferred embodiment uses ionization electrodes or ultraviolet sensors with series-connected diode which in dependence on flame intensity supply a corresponding dc signal. No dc signal is produced when the flame is extinguished. The second electrical signal ($I_F$) is detected by an evaluation circuit to which the ionization electrodes or the ultraviolet sensors are connected, and converted into a first output signal (A), wherein conversion is effected by various further circuit elements in such a way that differently dynamic output signals are obtained, depending on the respective flame intensity involved. Therefore with changing flame intensities the output signal (A) is an output signal which changes in terms of its dynamics.

The evaluation circuit is also acted upon by an electrical monitoring circuit (ac voltage signal) which can be derived for example from the ac voltage signal made available to the ionization electrodes, which upon failure of the evaluation circuit results in a second output signal ($A_A$). That second output signal, as in the case of flame failure, is advantageously a static signal, so that the monitoring apparatus immediately notes the failure of the evaluation circuit and can cause the fuel supply to be shut off.

The second electrical signal ($I_F$) is converted into a control signal (S) and passed on to a trigger stage. This trigger stage can be for example an operational amplifier which compares the control signal to a given threshold and then resets the evaluation circuit again by way of a reset signal (R) so that it can again control the trigger stage. In that way the output of the trigger stage is switched over between two output signals ($A_1$, $A_2$) in dependence on the control signal (S). The trigger stage switches to and fro at different rates in dependence on the flame intensity.

The control signal (S) can also be passed by way of a further evaluation circuit in order to improve the sensitivity of the circuit in relation to the second electrical signal, that is to say for example in relation to the direct current component in the sensor current. In order to check that second evaluation circuit, that is to say in order to detect a failure, its circuitry is connected to the control input of an integrator which is in the form of a charge pump and whose output signal reflects the magnitude of the second electrical signal, such as for example of the sensor current.

A monitoring circuit serves to detect a failure of the first evaluation circuit, the monitoring circuit being supplied by way of the evaluation circuit with a monitoring signal, that is to say for example an ac voltage signal, so that in the event of failure of the evaluation circuit the monitoring circuit is taken out of operation and that results in a static output signal ($A_A$). The output signal of the integrator becomes zero in the event of failure of the sensor current.

BRIEF DESCRIPTION OF THE DRAWINGS

A preferred embodiment of the invention is described in greater detail hereinafter with reference to the drawings in which.

DESCRIPTION OF THE PREFERRED EMBODIMENT

Figure 1:
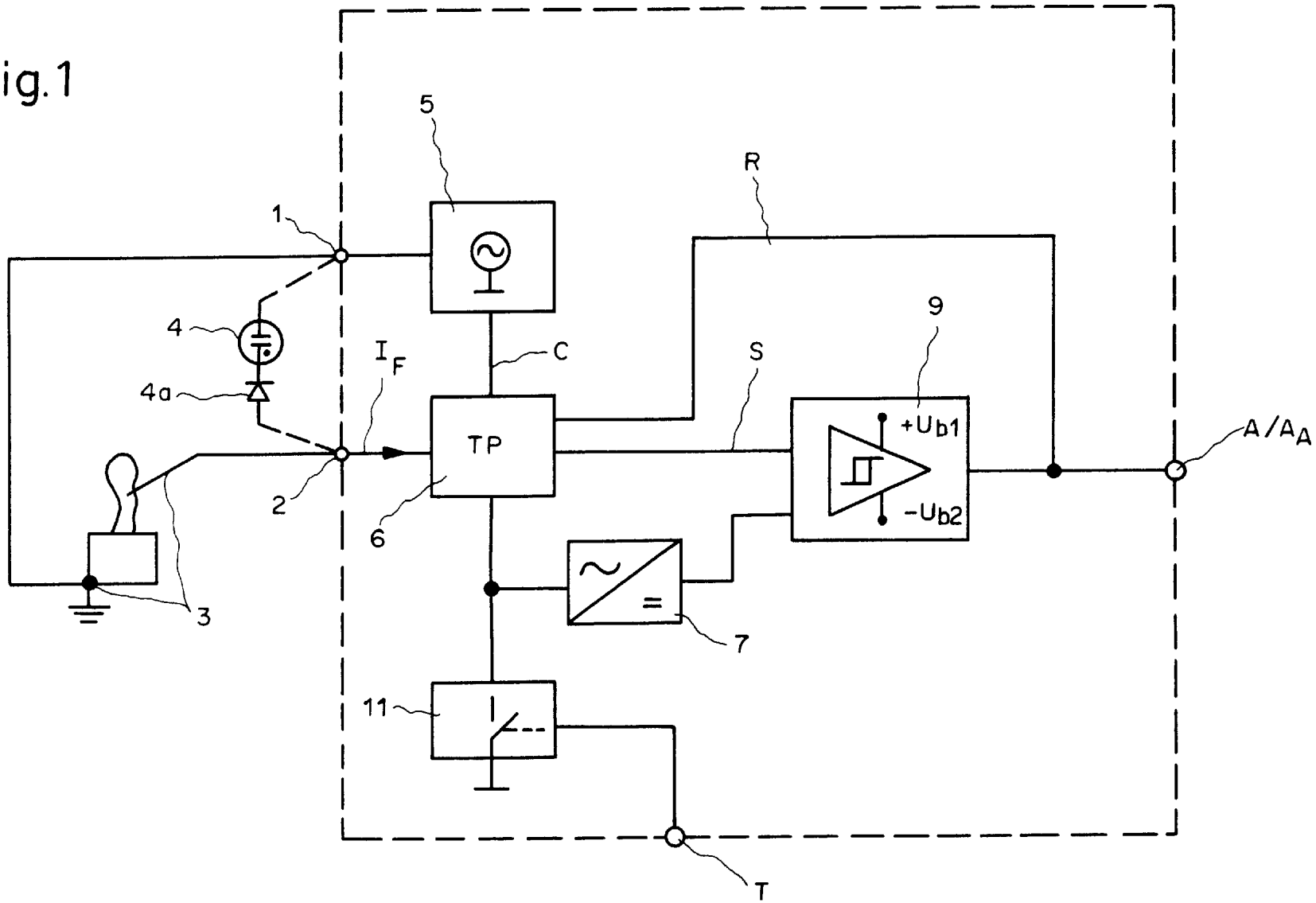
FIG. 1 is a diagrammatic view of the flame monitoring circuit.

FIG. 1 is a diagrammatic view of a preferred embodiment of apparatus according to the invention. Ionization electrodes 3 or ultraviolet sensors 4,4*a* are supplied by way of a connecting terminal 1 with the ac voltage signal from a suitable source 5 and supply the signal which is generated by the flame and on which an unwanted alternating current signal is superimposed to the terminal 2 at which an evaluation circuit 6, here a filter member, detects the direct current signal $I_F$. The control signal S is passed to the trigger stage 9 which outputs the output signal A, $A_A$. A reset line R serves to reset the evaluation circuit 6 so that an oscillating signal appears at the output of the trigger stage 9. If the evaluation circuit 6 comprises a low pass member TP with capacitor C1 and resistor R1, it has to be regularly reset.

The ac voltage source 5 also feeds the evaluation circuit 6 which transmits the monitoring signal, that is to say the ac voltage of the ac voltage source 5, to a monitoring circuit 7, here a charge pump, which puts the trigger stage 9 into a given condition which activates the trigger stage 9. Upon failure of the evaluation circuit 6 no signal is transmitted to the monitoring circuit 7 so that the trigger stage 9 is put into another static condition which interrupts further signalling of the flame intensity (output signal A) and then has the output signal $A_A$. In that way failure of the evaluation circuit 6 can be easily detected. A test signal T can be applied to a switch 11 which simulates failure of the evaluation circuit 6. It is thus possible once again to check the circuit for failure detection in respect of the evaluation circuit 6, in particular the charge pump and the trigger stage 9.

Figure 2:
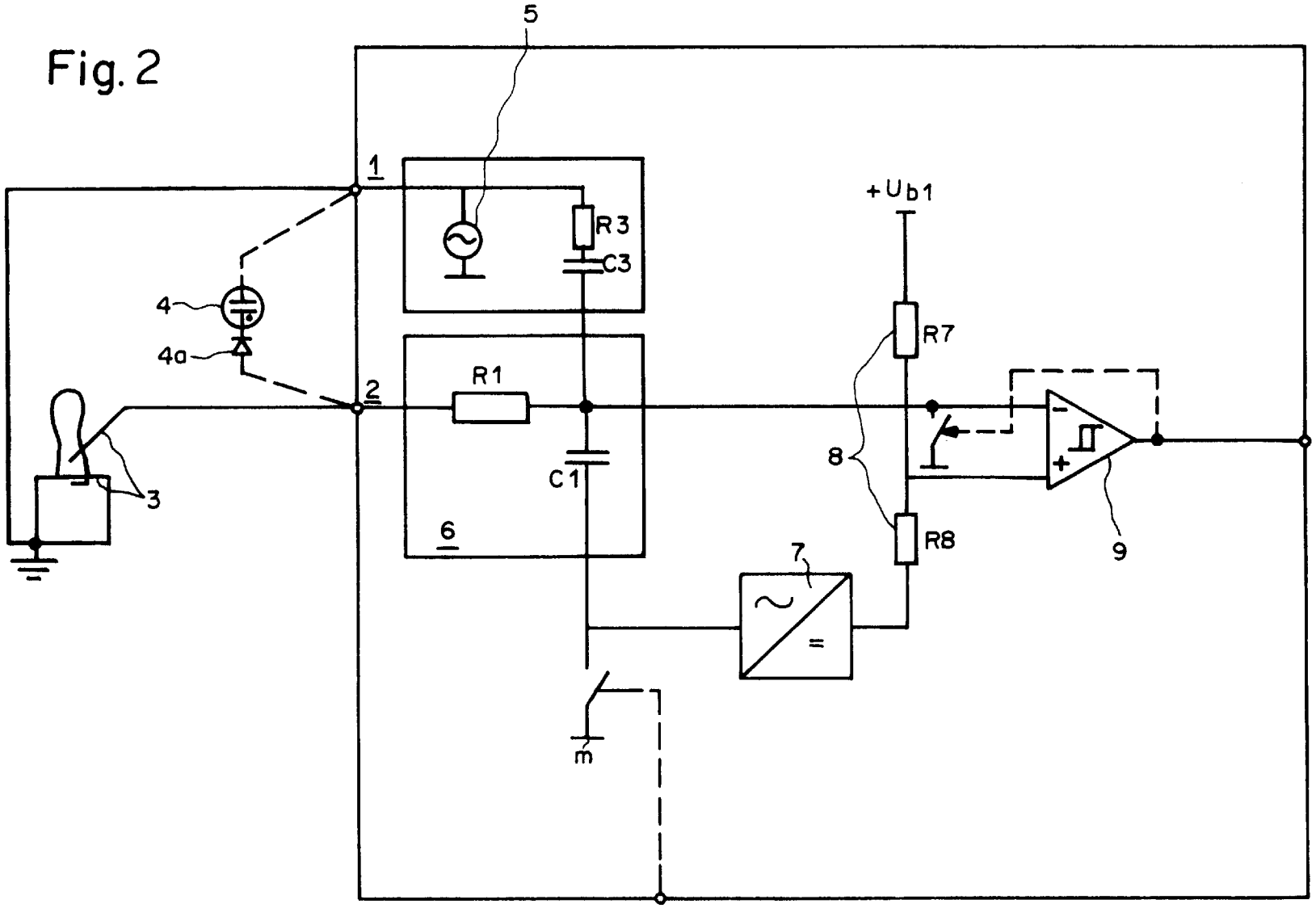
FIG. 2 shows a block circuit diagram of the flame monitoring circuit.
Figure 3:
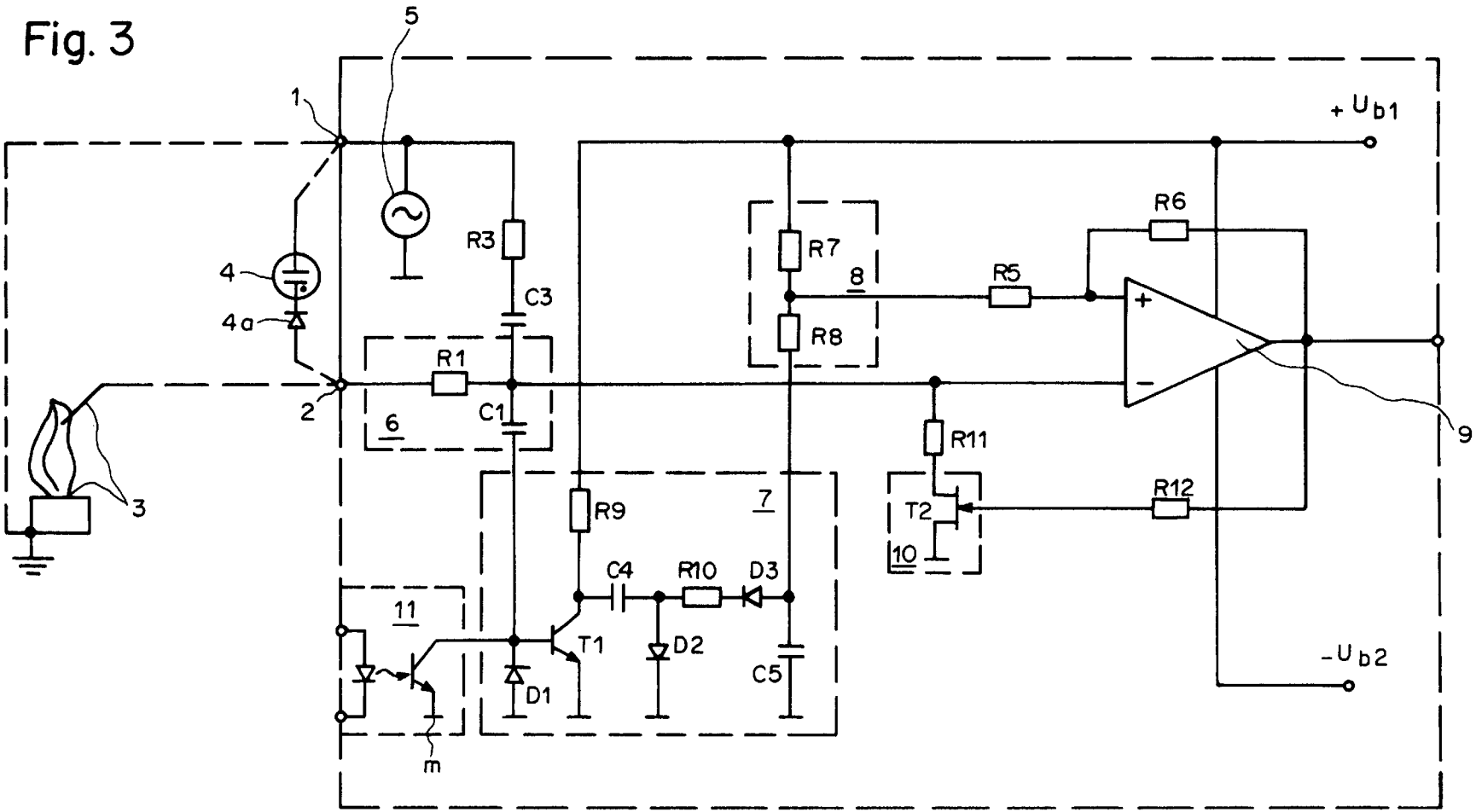
FIG. 3 shows a detailed circuit diagram of the flame monitoring circuit.

FIGS. 2 and 3 show a block circuit diagram and a detailed circuit diagram respectively of the flame monitoring circuit of the preferred embodiment. The circuit diagram shows the components with the usual symbols and the usual references. The precise wiring configuration involved will not be described in detail here, as it can be seen from FIGS. 2 and 3. The flame monitoring circuit is fed in bipolar mode by two operating voltages +Ub1 and −Ub2 defined with respect to a reference potential m. It has two terminals 1 and 2 which can be connected either to two ionization electrodes 3 or to the two terminals of an ultraviolet sensor comprising a gas-filled ultraviolet cell 4 and a diode 4*a* connected in series therewith. The first terminal 1 serves as an output which carries an ac voltage which is produced by an ac voltage generator 5 and which is defined with respect to the reference potential m. The second terminal 2 serves as an input to which the actual sensor signal is fed. Connected downstream of the second terminal 2 is a first low pass member 6 formed from a resistor R1 and a capacitor C1. The ac voltage produced by the ac voltage generator 5 is taken by way of a limiting resistor R3 and a coupling capacitor C3 to the capacitor C1 and to the input of a charge pump. The signal at the output of the charge pump is taken by way of a voltage divider 8 connected to the positive operating voltage, to the non-inverting input of an operational amplifier 9 which is connected as a Schmitt trigger. The inverting input of the operational amplifier 9 is connected to the output of the low pass member 6. The output of the operational amplifier 9 controls a switch 10 by way of which the capacitor C1 can be discharged.

The ac voltage which acts on the capacitor C1 and which in the illustrated example is derived from the ac voltage generated by the ac voltage generator 5 could also be generated by a second ac voltage generator.

Only a direct current flows in the sensor circuit between the ionization electrodes 3 because of the rectifying effect of the flame or in the ultraviolet cell 4 because of the diode 4*a*, more specifically only when the flame is actually burning. However an unwanted alternating current also constantly flows between the terminals 1 and 2, because of the inevitable capacitance of the sensor lines, and that alternating current is superimposed on the direct current. The flame monitoring circuit is now designed in such a way that this alternating current is not rectified and therefore cannot simulate a signal "flame present" when the flame is missing.

The flame monitoring circuit operates as follows: as long as the capacitor C1 is intact, the charge pump 7 carries at its output an approximately constant negative potential $U_{C5}$, whose absolute value is about 75–80% of the positive feed voltage +Ub1. The sizes of the resistors R7 and R8 of the voltage divider 8 are such that the voltage at the non-inverting input of the operational amplifier 9 is also negative. The output of the operational amplifier 9 firstly carries the negative operating voltage −Ub2 so that the switch 10 which is in the form of a junction field effect transistor T2 is open. As soon as the flame is present the direct current flowing between the ionization electrodes 3 or the photoelectric current of the ultraviolet sensor 4 charges up the capacitor C1 whose potential becomes increasingly more negative. As a consequence the voltage at the inverting input of the operational amplifier 9 also falls to an increasingly negative potential. As soon as the voltage at the inverting input of the operational amplifier 9 falls below the voltage at the non-inverting input of the operational amplifier 9, the output of the operational amplifier 9 carries the positive feed voltage +Ub1, the switch 10 closes and the capacitor C1 begins to discharge. Because of the resistors R5 and R6 the operational amplifier 9 has a certain switching hysteresis so that the capacitor C1 is partially discharged. When discharging of the capacitor C1 has progressed to a sufficient degree, the output of the operational amplifier 9 then switches over again and again carries the negative feed voltage −Ub2. The cycle thus begins again. The signal at the output of the operational amplifier 9 is a rectangular signal. The frequency thereof represents a measurement in respect of flame intensity as the strength of the direct current flowing between the ionization electrodes 3 determines the period of time which it takes to charge up the capacitor C1 until the operational amplifier 9 switches over again.

An interruption in the capacitor C1 has the result that the transistor T1 of the charge pump 7 is continuously non-conducting and the charge pump 7 is therefore out of operation. Consequently the capacitor C5 is charged up to the positive feed voltage Ub1 so that the output of the charge pump 7 and also the output of the operational amplifier 9 carry a static signal. A short-circuit of the capacitor C1 has the result that the charge pump 7 admittedly remains in operation, but the amplitude of the voltage at the inverting input of the operational amplifier 9 remains sufficiently small, in relation to the voltage at the non-inverting input, so that the output of the operational amplifier 9 again carries a static signal.

Only an alternating signal at the output of the operational amplifier 9 therefore means that the flame is present, while a uniform signal means either that the flame is not burning or that the flame monitoring circuit is defective.

With the proposed flame monitoring circuit, the amplitude of the ac voltage produced by the ac voltage generator 5, the resistor R3 and the capacitors C1 and C3 must be matched to each other in such a way that the amplitude of the ac voltage at the capacitor C3 and thus also at the inverting input of the operational amplifier 9 is not sufficient to cause the operational amplifier 9 which is connected as a Schmitt trigger to switch backward and forward and thus simulate a "flame present" signal.

In intermittent operation of the burner the flame monitoring circuit can be checked, whenever the burner is switched off, to ascertain whether no "flame present" signal appears at the output. In the case of a flame monitoring circuit which is suitable for continuous burner operation, there is a second switch 11 with which the input of the charge pump 7 can be connected to the reference potential m. When the switch 11 is closed then the information "flame not present" must appear at the output of the flame monitoring circuit and/or downstream-disposed circuits. The switch 11 is preferably operated by a microprocessor. The switch 11 shown in FIG. 3 is an optocoupler which is controlled by way of two inputs and which permits galvanically separated control.

Figure 4:
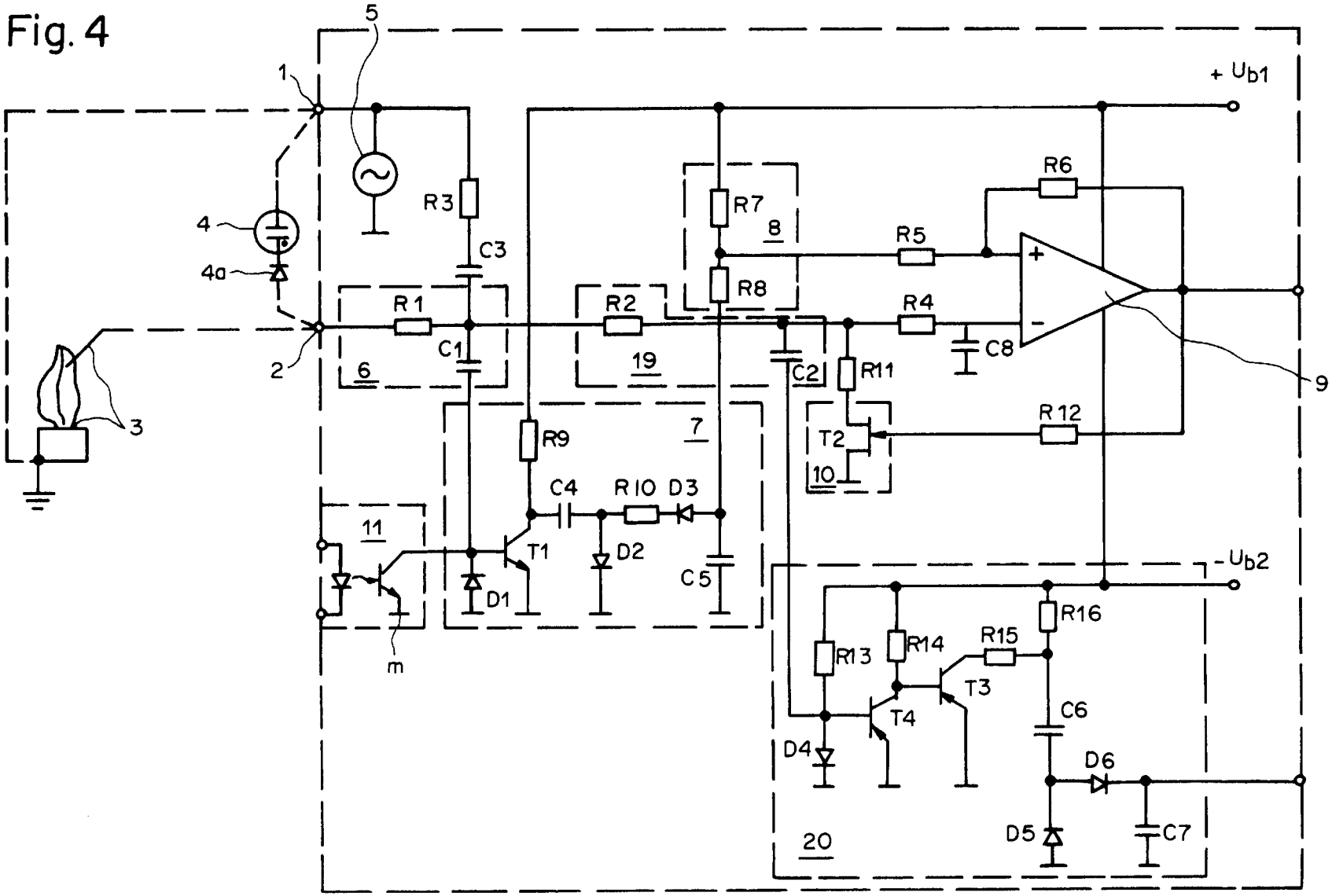
FIG. 4 shows a development of the flame monitoring circuit.

FIG. 4 shows a development of the flame monitoring circuit in which connected between the capacitor C1 and the input of the operational amplifier 9 is a second low pass member 19 formed from a resistor R2 and a capacitor C2. In this case the switch 10 controls discharging of the capacitor C2. In a similar manner to the capacitor C1 the capacitor C2 must be monitored for a possible interruption. The capacitor C2 is therefore connected to the input of an integrator 20, at the output of which there is a dc voltage whose level is a measurement in respect of flame intensity. The integrator 20 is in the form of a charge pump. The capacitor C7 is recharged in accordance with the frequency of the charge/discharge cycles of the capacitor C2 by way of the capacitor C6. The frequency is determined by the sensor current. In the event of an interruption of the capacitor C2 the voltage at the capacitor C7 assumes the value of the reference potential m, which is equivalent to "flame not present". The voltage at the capacitor C7 is digitized for example by means of a voltage/frequency converter and transmitted in galvanically separated fashion by way of an optocoupler to a superior item of equipment, for example an automatic firing assembly. The advantage of this circuit is that the low pass member 19 attenuates the ac voltage produced by the ac voltage generator 5, in such a way that a substantially greater ratio can be accepted between the alternating current caused by the sensor line capacitances and the ionization current.

If the flame is monitored with a UV-cell 4 which in contrast to the ionization electrodes 3 is not fail-safe because there is the danger that the UV-cell 4 fires for example as a result of ageing even when a flame is not present, the system comprising the UV-cell 4 and the flame monitoring circuit must be tested in continuous operation of the burner by blacking out the UV-cell 4. The switch 11 may not be operated then. It can be omitted if the flame monitoring circuit is to be used only with UV-cells 4.

Figure 5:
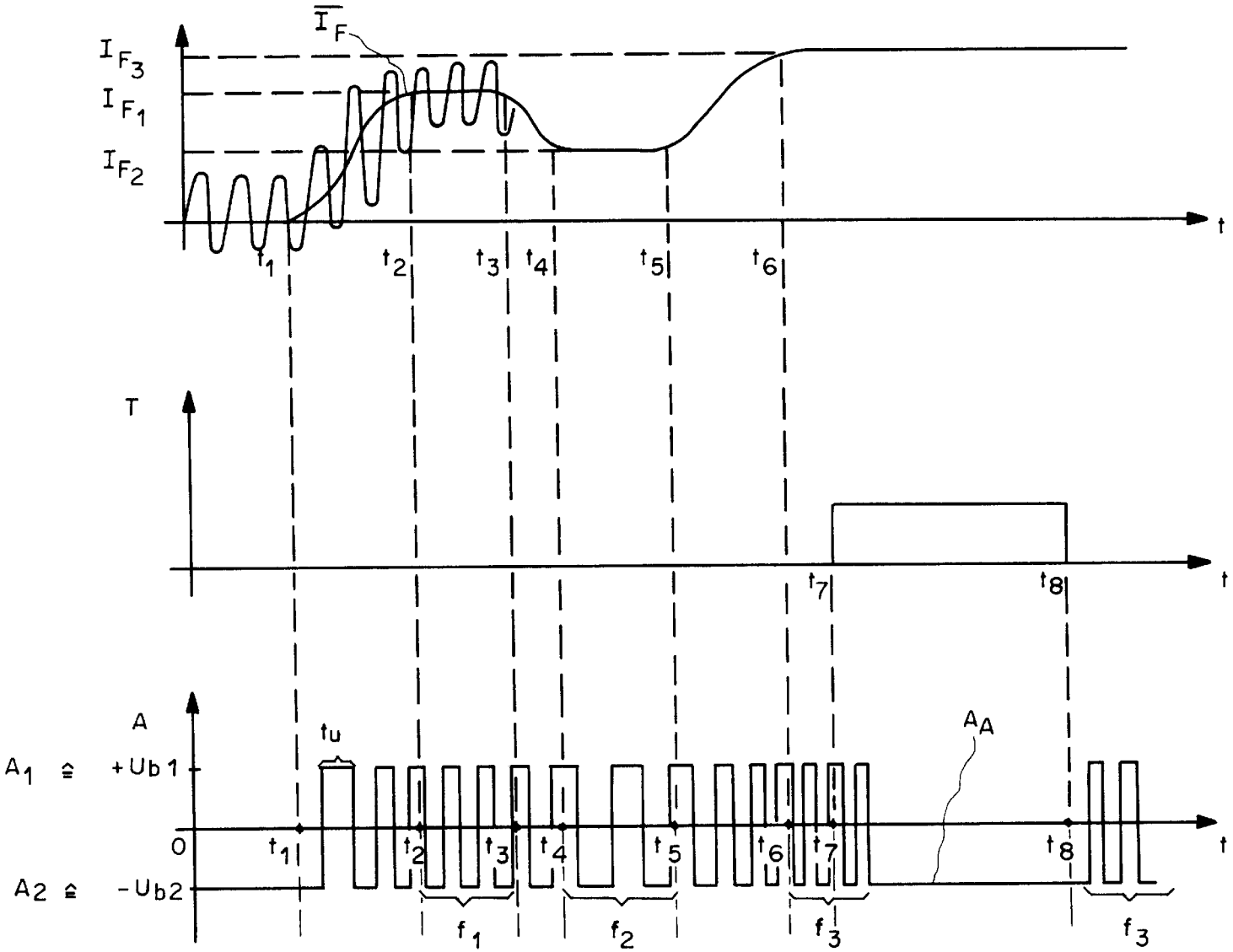
FIG. 5 shows three time diagrams of the direct current signal, the failure test and the output signal.

FIG. 5 shows time diagrams in respect of the signals shown in FIGS. 1 and 2. The uppermost diagram shows the direct current signal $I_F$ on which the alternating current signal is superimposed, in which case the alternating current signal is only shown in part for the sake of enhanced clarity. The flame begins to burn at the time $t_1$, and it is possible to see a direct current signal which rises to the time $t_2$. Until $t_3$ the flame intensity remains constant and then falls to $t_4$ in order there to remain at a lower level in order finally to rise again from the time $t_5$ and remain at a higher level from time $t_6$.

The lowermost diagram plots the output signal A which switches to and fro between the two limit values of the trigger stage 9 or the operational amplifier $A_1$=+Ub1, $A_2$=−Ub2. Up to the time $t_1$ there is no charging of C1 and the amplifier output remains at $A_2$. After the flame produces a direct current the capacitor C1 of the low pass filter charges up and after a certain charging time causes the trigger stage 9 to switch over. Between the times $t_2$ and $t_3$ the change-over switching time $t_u$ is approximately constant so that a given frequency $f_1$ is set, representing a measurement in respect of flame intensity. Between the times $t_4$ and $t_5$ there is a frequency $f_2$ and from $t_6$ there is the frequency $f_3$. Each of the frequencies is therefore associated with one of the direct current signals $I_{F1}$, $I_{F2}$ and $I_{F3}$.

Shown in the middle of the diagrams is the test signal T which is applied between the times $t_7$ and $t_8$. When the charge pump 7 is operating, that results in fixing the potential of an input of the amplifier so that—when the trigger stage is functioning—there is no longer any change-over switching action. That can be seen in the output signal diagram between the corresponding times, with a minor time lag. That output signal $A_A$ therefore shows that the circuit is intact, that is to say the circuit can be tested even in uninterrupted operation of the burner. Without the test signal T the signal $A_A$ signals absence of the flame.

I claim:

1. A method of monitoring a flame, wherein:

in dependence on the presence of intensity of the flame there is produced by means of a sensor from a first electrical signal supplied to the sensor a second electrical signal of different magnitude, and the second electrical signal is applied to an evaluation circuit and converted into a first output signal, wherein a monitoring circuit is acted upon by a monitoring signal by means of the evaluation circuit so that in the event of failure of the evaluation circuit a second output signal is produced by means of the monitoring circuit, and wherein the monitoring circuit is a charge pump and the monitoring signal is an ac voltage signal so that in the event of failure of the evaluation circuit the charge pump is taken out of operation and that results in the second output signal being produced as the second output signal.

2. A method as set forth in claim 1, wherein the first output signal is an alternating signal and the second output signal is a uniform or static signal.

3. A method as set forth in claim 1, wherein the second electrical signal is a direct current signal and is converted by the evaluation circuit into a control signal and passed to a trigger stage, the trigger stage is switched over in dependence on the control signal between two output signals, and different change-over switching times occur between the output signals in dependence on the magnitude of the direct current signal.

4. A method as set forth in claim 3, wherein the control signal is applied to a further evaluation circuit and integrated by means of an integrator, and the integrated signal is either converted by means of a voltage-frequency converter into the first output signal or itself serves as the first output signal.

5. A method as set forth in claim 4, wherein the integrated signal of the integrator results in an output signal of zero in the event of failure of the further evaluation circuit.

6. A method as set forth in claim 1, wherein the first output signal is used to indicate the intensity of the flame.

7. A method as set forth in claim 1, wherein the monitoring circuit is checked by applying thereto a test signal to check that the second output signal is produced.

8. Apparatus for monitoring a flame, comprising:

an evaluation circuit which in dependence on the presence or the intensity of the flame generates be means of a sensor from a first electrical signal supplied to the sensor a second electrical signal of different magnitude, circuit means which converts the second electrical signal into a first output signal, and a monitoring circuit configured to be acted upon with a monitoring signal by means of the evaluation circuit so that in the event of failure of the evaluation circuit, a second output signal is produced by means of the monitoring circuit, wherein the evaluation circuit is a low pass member having a resistor and a capacitor, the monitoring signal is an ac voltage, the monitoring circuit is a charge pump, and the capacitor can be acted upon by the ac voltage in order to produce the second output signal as the second output signal in the event of failure of the capacitor.

9. Apparatus as set forth in claim 8, wherein the ac voltage with which the evaluation circuit can be acted upon can be applied to the input of the charge pump, and the charge pump has an output which carries an approximately constant potential of a first polarity when an alternating signal occurs at the input thereof and which carries a constant potential of a second polarity when a uniform or static signal occurs at the input thereof, so that the signal at the output of the charge pump indicates whether the evaluation circuit is defective.

10. Apparatus as set forth in claim 8, wherein the capacitor of the evaluation circuit is connected to the first input of an operational amplifier connected as a Schmitt trigger, the potential at the output of the charge pump controls the potential at the second input of the operational amplifier, and the output of the operational amplifier controls a switch by way of which the capacitor can be discharged so that a rectangular signal appears at the output of the operational amplifier when a flame is present.

11. Apparatus as set forth in claim 10, wherein connected between the capacitor and the first input of the operational amplifier is a further evaluation circuit having a second resistor and a second capacitor, and the second capacitor is connected to the input of an integrator, and at its output the integrator carries an approximately uniform voltage whose level is a measurement of the frequency with which the second capacitor is discharged through the switch.

12. Apparatus as set forth in claim 8, wherein there is a switch with which a test signal "flame not present" can be applied to the input of the monitoring circuit so that even when a flame is present it is possible at any time to check whether the individual circuit means of the apparatus are operating correctly.

* * * * *